US009752320B2

(12) United States Patent
Bowen

(10) Patent No.: US 9,752,320 B2
(45) Date of Patent: Sep. 5, 2017

(54) TRIM ASSEMBLY FOR A FLEXIBLE PANEL IN A FALSE CEILING

(71) Applicant: John Bowen, Harrison Township, MI (US)

(72) Inventor: John Bowen, Harrison Township, MI (US)

( * ) Notice: Subject to any disclaimer, the term of this patent is extended or adjusted under 35 U.S.C. 154(b) by 0 days.

(21) Appl. No.: 15/185,574

(22) Filed: Jun. 17, 2016

(65) Prior Publication Data

US 2016/0289965 A1 Oct. 6, 2016

Related U.S. Application Data

(63) Continuation of application No. 14/322,098, filed on Jul. 2, 2014, now Pat. No. 9,388,576.

(51) Int. Cl.

| | |
|---|---|
| ***E04B 9/24*** | (2006.01) |
| ***E04B 1/41*** | (2006.01) |
| ***E04B 9/30*** | (2006.01) |
| ***E04F 19/02*** | (2006.01) |
| ***E04F 13/072*** | (2006.01) |
| ***E04F 13/26*** | (2006.01) |
| ***E04F 13/00*** | (2006.01) |
| *E04B 9/32* | (2006.01) |

(52) U.S. Cl.

CPC ..... *E04B 9/242* (2013.01); *E04B 1/40* (2013.01); *E04B 9/303* (2013.01); *E04F 13/005* (2013.01); *E04F 13/072* (2013.01); *E04F 13/26* (2013.01); *E04F 19/02* (2013.01); *E04B 9/32* (2013.01)

(58) Field of Classification Search

None

See application file for complete search history.

(56) References Cited

U.S. PATENT DOCUMENTS

| | | | | |
|---|---|---|---|---|
| 2,857,631 | A | 10/1958 | Zingone | |
| 4,385,474 | A * | 5/1983 | Earley | B60P 3/32 52/3 |
| 4,606,394 | A * | 8/1986 | Bannister | E04B 2/7416 16/354 |
| 4,648,231 | A | 3/1987 | Laroche et al. | |
| 4,768,317 | A * | 9/1988 | Markham | E04H 15/58 135/117 |
| 4,986,332 | A | 1/1991 | Lanuza | |
| 5,029,422 | A | 7/1991 | Scherrer | |
| 5,065,562 | A | 11/1991 | Larsen et al. | |
| 5,197,238 | A * | 3/1993 | Peleg | A01G 9/1407 47/17 |
| 5,377,711 | A * | 1/1995 | Mueller | E04H 15/001 135/115 |
| 5,414,950 | A * | 5/1995 | Johnson, Sr. | A01M 31/025 135/119 |

(Continued)

*Primary Examiner* — Brian Glessner
*Assistant Examiner* — Adam Barlow
(74) *Attorney, Agent, or Firm* — Young Basile Hanlon & MacFarlane, P.C.

(57) ABSTRACT

A decor apparatus is based on a flexible panel. In the apparatus, a support structure includes a rail, and a flexible panel having an edge is attached to the rail, with the attachment between the rail and the edge including a plurality of discrete attachment points. A trim piece for the flexible panel is connected to the rail from between the attachment points. The trim piece overlays the attachment between the rail and the edge outside of a plane of the flexible panel.

14 Claims, 4 Drawing Sheets

(56) References Cited

U.S. PATENT DOCUMENTS

| | | | | |
|---|---|---|---|---|
| 5,579,624 | A | 12/1996 | Aeberhard | |
| 5,735,069 | A | 4/1998 | Gearing | |
| 6,164,364 | A | 12/2000 | Morris | |
| 6,393,748 | B1 | 5/2002 | Cooper | |
| 6,574,936 | B1 | 6/2003 | Anderson, Sr. | |
| 6,883,260 | B1 | 4/2005 | Cobb et al. | |
| 6,959,518 | B2 | 11/2005 | Cousin | |
| 7,096,633 | B1 * | 8/2006 | Bowen | E04B 9/064 52/476 |
| 7,269,927 | B2 | 9/2007 | Savard | |
| 7,530,540 | B2 * | 5/2009 | Long | E04B 2/744 248/219.1 |
| 7,610,727 | B2 * | 11/2009 | Toledo | A47F 3/002 135/114 |
| 7,810,294 | B2 | 10/2010 | Maley et al. | |
| 8,056,602 | B1 * | 11/2011 | Green | E06B 9/52 160/392 |
| 2003/0163966 | A1 | 9/2003 | Reynolds et al. | |
| 2006/0042141 | A1 | 3/2006 | Hansen et al. | |
| 2007/0039251 | A1 | 2/2007 | Morris | |
| 2007/0182181 | A1 | 8/2007 | Cohen et al. | |
| 2007/0283656 | A1 | 12/2007 | Anderson | |
| 2008/0010878 | A1 | 1/2008 | Hansen et al. | |
| 2008/0289281 | A1 | 11/2008 | Greiner | |
| 2009/0255203 | A1 | 10/2009 | Richardson et al. | |
| 2010/0077686 | A1 * | 4/2010 | Bowen | E04B 9/303 52/506.06 |

* cited by examiner

TRIM ASSEMBLY FOR A FLEXIBLE PANEL IN A FALSE CEILING

CROSS-REFERENCE TO RELATED APPLICATIONS

This continuation application claims priority benefit to pending U.S. patent application Ser. No. 14/322,098, filed Jul. 2, 2014, the entire contents of which is incorporated herein by reference.

TECHNICAL FIELD

The embodiments disclosed herein generally relate to a false ceiling having a flexible panel suspended by its edges from a rigid support structure. The embodiments more particularly relate to the components of a trim assembly for the flexible panel.

BACKGROUND

A flexible panel can be attached at its edges to a rigid overhead support structure and suspended from the support structure to simulate a ceiling. The so-called false ceiling can be applied in an outdoor space or in a variety of indoor spaces including, for example, showrooms, entertainment halls, exhibition halls, industrial spaces and offices. In an outdoor application, the flexible panel can create a canopy defining in whole or in part an auxiliary outdoor space. In an indoor application, the flexible panel can similarly define in whole or in part an auxiliary indoor space. Moreover, the flexible panel can be suspended below an existing ceiling to obscure the view of unsightly exposed ceiling structures such as beams and trusses, as well as the components of electrical, hydraulic and HVAC systems.

In some false ceilings, the edges of the flexible panel are attached to elongate rails in the support structure at discrete attachment points. The flexible panel, for instance, may have holes defined at its edges, with the flexible panel being tethered or otherwise attached to the elongate rails through the holes. This type of false ceiling, although functionally satisfactory, can provide an unsatisfactory visual experience at the attachment between the elongate rails and the edges of the flexible panel.

SUMMARY

Disclosed herein are a flexible panel-based decor apparatus and the components of a trim assembly for the flexible panel. In one aspect, a flexible panel-based decor apparatus comprises a support structure including a rail; a flexible panel having an edge attached to the rail, with the attachment between the rail and the edge including a plurality of discrete attachment points; and a trim piece for the flexible panel, the trim piece connected to the rail from between the attachment points, and overlying the attachment between the rail and the edge outside of a plane of the flexible panel.

In another aspect, a trim assembly for a flexible panel having an edge attached to a rail in a support structure, with the attachment between the rail and the edge including a plurality of discrete attachment points, comprises an elongate perimeter trim piece including a cover portion for overlying the attachment between the rail and the edge, the cover portion having an inner side and an opposing outer side, with the inner side including the first of two portions of a connection assembly for connecting the perimeter trim piece to the rail, and with the outer side defining a display face.

These and other aspects will be described in additional detail below.

BRIEF DESCRIPTION OF THE DRAWINGS

The various features, advantages and other uses of the present apparatus will become more apparent by referring to the following detailed description and drawings in which.

DETAILED DESCRIPTION

The following description is directed to an example of a decor element, or apparatus, whose construction is based on a flexible panel. The flexible panel is suspended by its edges from a rigid support structure that can be, or include, one or more elongate rails, with the edges of the flexible panel being attached to the elongate rails at discrete attachment points. Trim pieces are also connected to the elongate rails from selective locations between the attachment points. In general, the trim pieces are configured to overlay the attachment between the elongate rail and the edges of the flexible panel in order to improve a user's visual experience with respect to the flexible panel. The locations of the trim pieces' connection to the elongate rails can be selected to accommodate the connection of other components to the elongate rails.

In the example, the decor element's support structure is an overhead support structure and the flexible panel is suspended from the support structure in a horizontal orientation, and, according to the example, the decor element is a false ceiling. It will however be understood that, with different support structures and/or orientations of the flexible panel, the same general construction can be used for other types of decor elements, such as those creating or simulating a wall, a partition or a display, for instance.

Figure 1:
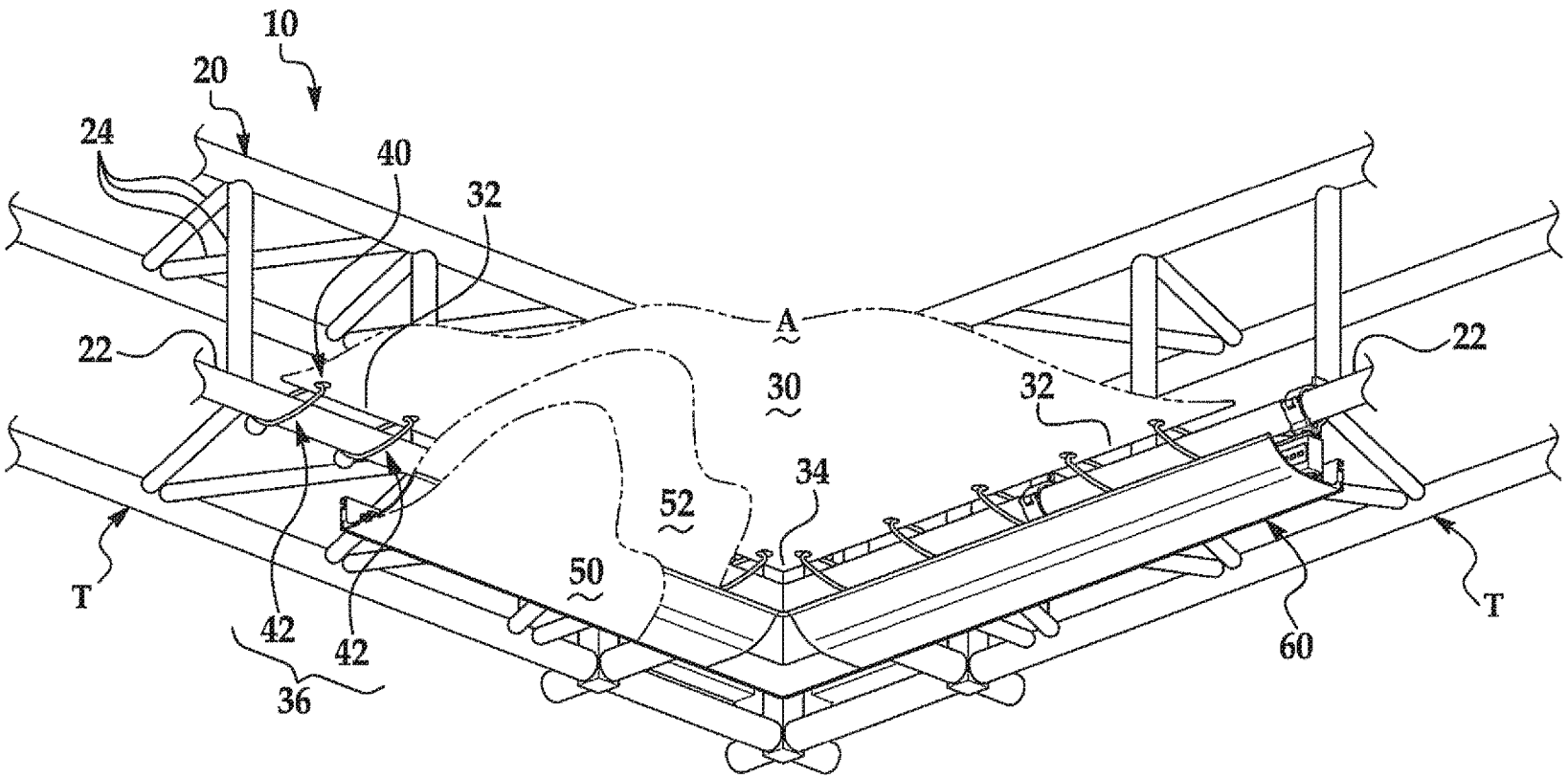
FIG. 1 is perspective view of an example of a false ceiling including a rigid support structure, a flexible panel and a trim assembly for the flexible panel.

The components of an example false ceiling 10 are shown in FIG. 1. The false ceiling 10 includes a rigid, overhead support structure 20. The support structure 20 is a generally open structure that can be, or include, one or more elongate rails 22. The one or more elongate rails 22 can be shaped and/or spaced and angled relative to one another to define an inside area A of the support structure 20.

In the illustrated support structure 20, the elongate rails 22 are included in support trusses T (two shown) used to frame the support structure 20. The partial depiction of the support structure 20 in FIG. 1 shows the juncture of two support trusses T forming a corner of the support structure 20. The remainder of the support structure 20 may be framed with additional support trusses T to form a closed loop or open ended structure.

The illustrated support trusses T are typical of those used in outdoor and indoor spaces to support, among other components, stage lighting and audio equipment. As shown, each of the support trusses T is a linear square truss including four parallel and orthogonally opposed linear elongate rails 22 that run the length of the support truss T. The elongate rails 22 may optionally be interconnected with a number transverse rails 24 arranged perpendicularly or diagonally with respect to the elongate rails 22. The elongate rails 22 and the transverse rails 24 can be hollow or solid, with circular, square or rectangular profiles, for example. Common materials for the support truss T include aluminum and carbon fiber, although other suitable materials may be used based on strength, weight, cost and other considerations.

In the false ceiling 10, the support structure 20 can be freestanding, with upright supports supporting the illustrated and other support trusses T from the ground, a floor surface or other foundation. Alternatively, the illustrated and other support trusses T can be suspended from an existing ceiling structure using, for example, cables or other supports.

The false ceiling 10 further includes a flexible panel 30. The flexible panel 30 is generally shaped and sized to at least partially span the inside area A of the support structure 20. As shown, the flexible panel 30 has edges 32 along its perimeter. In the false ceiling 10, one, some or all of the edges 32 are configured for alignment with an elongate rail 22 defining the inside area A of the support structure 20. In application, at least one of the aligned edges 32 is attached to an elongate rail 22 to at least partially suspend the flexible panel 30 from the support structure 20.

The illustrated portion of the flexible panel 30 includes two straight edges 32 aligned with, and attached to, respective elongate rails 22 that extend from the corner of the support structure 20. The flexible panel 30 further includes a corner 34 at the intersection of the two adjacent edges 32 that generally corresponds with the angle between the respective elongate rails 22. The remaining edges 32 of the flexible panel 30 may similarly be aligned with, and attached to, other elongate rails 22 in the support structure 20. Optionally, one or more of the remaining edges 32 could be free from attachment to an elongate rail 22.

In the illustrated example of the false ceiling 10, the elongate rails 22 to which the edges 32 of the flexible panel 20 are attached are those that form an inside perimeter of the support structure 20. In this example, the attachment of the edges 32 to the elongate rails 22 leaves the core of each of the support trusses T open for the connection of other components, such as stage lighting and audio equipment.

As shown, a given edge 32 of the flexible panel 30 is aligned with, but spaced slightly from, an elongate rail 22, and is attached to the elongate rail 22 at a plurality of discrete attachment points 36 along the elongate rail 22. In contrast to, for example, the edge 32 of the flexible panel 30 being continuously attached along the elongate rail 22, the spacing of an edge 32 from the elongate rail 22, and its attachment at a plurality of discrete attachment points 36 along the elongate rail 22, leaves sections of the elongate rail 22 open for the connection of other components.

The flexible panel 30 can be configured in a variety of manners to accommodate the attachment of its edges 32 to the elongate rails 22. In the illustrated example of the false ceiling 10, for instance, the flexible panel 30 has multiple grommeted holes 40 defined at its edges 32. The attachment between a given edge 32 of the flexible panel 30 and an elongate rail 22 can be implemented by tethering or otherwise attaching the edge 32 to the elongate rail 22 through the holes 40. As shown, for instance, the false ceiling 10 can include so-called ball bungees 42 looped through each of the holes 40 and around the elongate rail 22, with the location of each ball bungee 42 corresponding to one of the plurality of discrete attachment points 36 along the elongate rail 22. Although the ball bungees 42 are given as a non-limiting example for implementing the attachment between the edge 32 of the flexible panel 30 and the elongate rail 22, it will be understood that other structures, such as ropes or s-hooks, for instance, can be used.

As shown, the false ceiling 10 may further support the suspension of additional, or alternative, auxiliary flexible panels 50 and 52 with respect to the support structure 20. As explained in additional detail below, in the illustrated false ceiling 10, the auxiliary flexible panels 50 and 52 can be attached to one or more of the components of a trim assembly 60 for the flexible panel 32.

The flexible panel 30 and the auxiliary flexible panels 50 and 52 may be selected for their appearance, weight, sound dampening capabilities, fire retardant qualities or other features. The flexible panel 30 and the auxiliary flexible panels 50 and 52 can be textured, colored, hued, patterned, printed with designs or graphics or otherwise configured with decorative properties. The flexible panel 30 and the auxiliary flexible panels 50 and 52 can be elastic or inelastic, and can include one or more of synthetic materials such as nylon and vinyl, cotton, wool, leather or other suitable materials. In application in the false ceiling 10, the flexible panel 30 and the auxiliary flexible panels 50 and 52 can be attached under tension, for example, or draped. In one example application, the flexible panel 30 is elastic and suspended under tension from the support structure 20.

The trim assembly 60 is generally configured to trim the edges 32 of the flexible panel 30. This can be advantageous, among other things, in improving a user's visual experience with respect to the flexible panel 30 in the false ceiling 10.

The trim assembly 60 is supported with respect to the support structure 30 by one or more attachments to the elongate rails 22. With the above described attachment between the elongate rails 22 and the edges 32 of the flexible panel 30, the attachments for the trim assembly 60 can be made at the option of a user at any selected location on the open sections of the elongate rails 22 between the discrete attachment points 36 for the flexible panel 30. The attachments for the trim assembly 60 can be located, for instance, to avoid interference with the transverse rails 24 of the support trusses T or with other components connected to the elongate rails 22.

Figure 2:
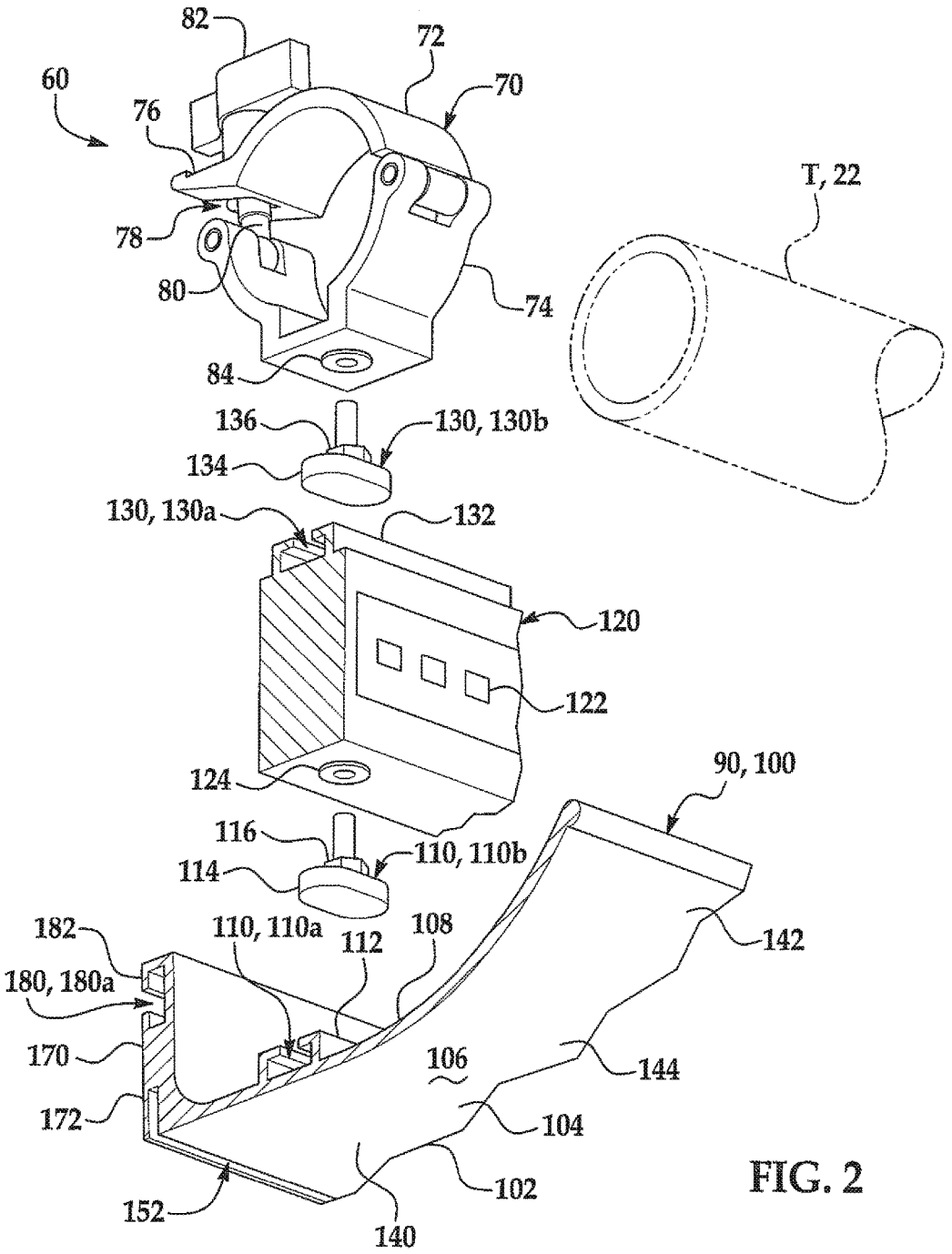
FIG. 2 is an assembly view of the trim assembly, showing a clamp, a light bar and a perimeter trim piece.
Figure 3:
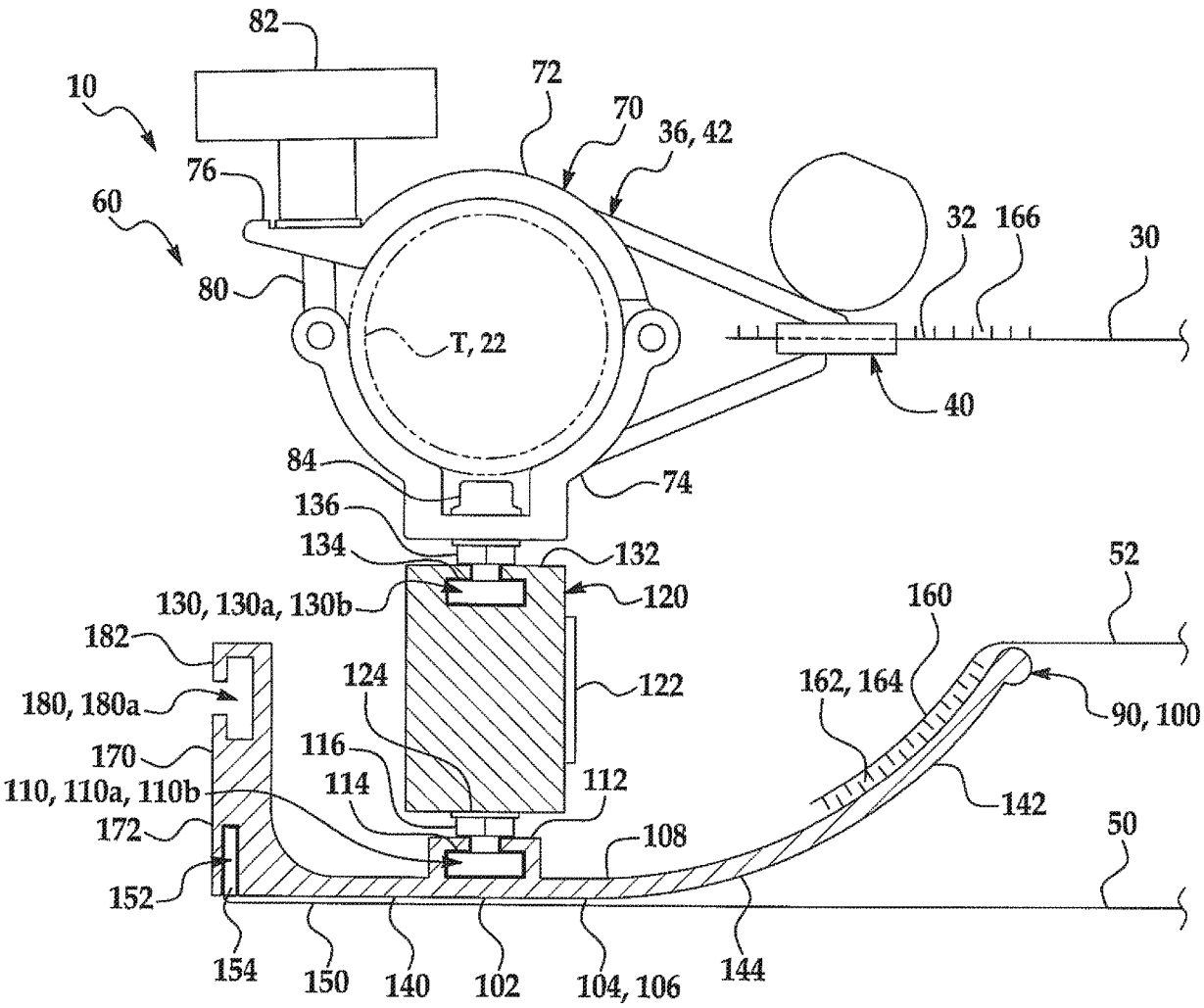
FIG. 3 is a section view of the trim assembly.

As shown with additional reference to FIGS. 2 and 3, the trim assembly 60 in the example false ceiling 10 includes a number of clamps 70 configured for attachment to the elongate rails 22 to anchor, directly or indirectly, the remaining components of the trim assembly 60. In the illustrated example, a given clamp 70 includes opposed, pivotally connected U-shaped bodies 72 and 74 sized and shaped to cooperatively close around an elongate rail 22. The U-shaped body 72 includes a radially outwardly extending flange 76 defining a slot 78, and the U-shaped body 74 includes a pivotally connected bolt 80 carrying a handle 82. The bolt 80 carries the handle 82 in threaded engagement. The U-shaped body 74 further includes a threaded insert 84 at its base for accommodating the connection of the components of the trim assembly 60, as explained below.

The clamp 70 as illustrated is closed, with the bolt 80 positioned inside the slot 78, and the handle 82 threadedly engaged with the bolt 80 into urged engagement against the flange 76. When closed, the clamp 70 can be securely attached to an elongate rail 22. The clamp 70 can be opened, and unattached from an elongate rail 22, by threadedly engaging the handle 82 with the bolt 80 out of its engagement against the flange 76, pivotally removing the bolt 80 from the slot 78, and pivoting the U-shaped body 72 away from the U-shaped body 74. Although the clamps 70 are given as non-limiting examples, it will be understood that other components can be used to make the attachments to the elongate rails 22 for supporting the trim assembly 60.

The trim assembly 60 further includes one or more trim pieces 90. The trim pieces 90 are each configured to connect to one or more of the clamps 70. In application, the trim pieces 90 are collectively configured to trim the edges 32 of the flexible panel 30 by overlying, in whole or in part, the attachment between the elongate rails 22 and the edges 32 of the flexible panel 30.

In a given false ceiling 10, the number and arrangement of the trim pieces 90 can vary based upon a combination of factors including but not limited to the individual configurations of the trim pieces 90, the shape and size of the flexible panel 30, particularly as it concerns those of the edges 32 of the flexible panel 30 that are attached to an elongate rail 22, and the available locations for the clamps 70 along the elongate rails 22. Below, the function and structure of the trim pieces 90 is described with reference to the illustrated example of the false ceiling 10, in which the flexible panel 30 includes two straight edges 32 aligned with, and attached to, respective linear elongate rails 22, and a corner 34 at the intersection of the two adjacent edges 32 generally corresponding with the angle between the respective elongate rails 22. In different examples of the false ceiling 10, it will be understood that the specifically illustrated structure of the trim pieces 90 can be modified consistently with their described functions to accommodate among other things curvature in one or more of the elongate rails 22, curvature in the edges 32 of the flexible panel 30, a differently shaped corner 34 of the flexible panel 30, or the lack of a corner 34 in the flexible panel 30.

The trim pieces 90 may include the illustrated elongate perimeter trim pieces 100. In the false ceiling 10, each of the perimeter trim pieces 100 extends in alignment with the full or partial length of an edge 32 of the flexible panel 30 that is attached to an elongate rail 22. As can be seen with reference to the depiction of the perimeter trim piece 100 in FIGS. 2 and 3, each perimeter trim piece 100 includes a cover portion 102 that, in application, overlays the attachment between the elongate rail 22 and the edge 32. The cover portion 102 is a generally flat body of material having a first, outer side 104 defining a display face 106, and an opposing second, inner side 108 that includes the first portion 110*a* of a connection assembly 110 for connecting the perimeter trim piece 100 to an elongate rail 22.

The connection assembly 110 generally includes the first portion 110*a* on the inner side 108 of the cover portion 102 of the perimeter trim piece 100, and a second portion 110*b* configured for selective mateable engagement with the first portion 110*a*, and further, for connection to a clamp 70. As shown, the first portion 110*a* of the connection assembly 110 comprises a track 112 that opens from the inner side 108 of the cover portion 102 and extends along the inner side 108 in a longitudinal direction of the perimeter trim piece 100. The second portion 110*b* of the connection assembly 110 comprises one or more projections 114 each configured for selective mateable engagement with the track 112. Each projection 114 can be generally configured for slidable engagement with the track 112, such that the projection 114 can be slid into the track 112 and selectively positioned therein. In the illustrated example, the track 112 is a C-shaped member defining a female channel, and each projection 114 is a male projection having a T-shaped cross section generally corresponding in shape with the channel defined by the track 112.

As noted above, each projection 114 is further generally configured for connection to a clamp 70. In the trim assembly 60, each projection 114 may, for instance, be threaded for threaded engagement with the insert 84 of a clamp 70. In an alternative implementation, as illustrated, the trim assembly 60 can include an optional light bar 120 with one or more illumination sources 122, and each projection 114 may be threaded for threaded engagement with a similar insert 124 included in the light bar 120. According to this implementation, as shown, the light bar 120 includes the first portion 130*a* of an additional connection assembly 130 for connecting the perimeter trim piece 100 to an elongate rail 22. Similarly to the connection assembly 110, the connection assembly 130 further includes a second portion 130*b* configured for selective mateable engagement with the first portion 130*a*. In a similar configuration as the connection assembly 110, the first portion 130*a* of the connection assembly 130 can comprise a track 132 constructed as a C-shaped member defining a female channel, and the second portion 130*b* of the connection assembly 130 can comprise one or more male projections 134 each having a T-shaped cross section generally corresponding in shape with the channel defined by the track 132 and configured for selective mateable engagement with the track 132.

The projection 114 may include jamb nut 116 for securing the position of the projection 114 within, depending upon the implementation, the insert 84 of a clamp 70 or the inert 124 of the light bar 120. Similarly, the projection 134 may include a jamb nut 136 for securing the position of the projection 134 within the insert 84 of a clamp 70. To support a given perimeter trim piece 100 with respect to an elongate rail 22, the projections 114 or the projections 134, depending upon the implementation, can be positioned approximately every three or four feet along the length of the perimeter trim piece 100 for mateable engagement with the track 112.

In application, the cover portion 102 of the perimeter trim piece 100 is positioned adjacent to the flexible panel 30 but at least partially outside of its plane in order to overlay the attachment between the elongate rail 22 to which the perimeter trim piece 100 is connected and an attached edge 32 of the flexible panel 30. The display face 106 defined by the outer side 104 of the cover portion 102, from the point of view of a user below the false ceiling 10, acts as a facade for the attachment between the elongate rail 22 and the edge 32 of the flexible panel 30. The display face 106 can be configured with decorative properties matching or otherwise compatible with those of the flexible panel 30. The display face 106 can be a continuous surface or a surface having interstitial vacancies, for example.

The display face 106 can further be angled, shaped or otherwise contoured to provide a semblance of continuity between the perimeter trim piece 100 and the flexible panel 30. In the illustrated example of the perimeter trim piece 100, for instance, the display face 106 partially extends in parallel to the plane of the flexible sheet 30, and is progressively inclined towards the flexible sheet 30 in a transverse direction of the perimeter trim piece 100. With the cover portion 102 being a generally flat body of material, in this example, the cover portion 102 includes a generally planar portion 140 opposite the first portion 110*a* of the connection assembly 110 that overlies the elongate rail 22 and the clamps 70, and an upwardly extending arcuate lip 142 inclined towards the flexible sheet 30, with an elbow portion 144 between the planar portion 140 and the lip 142.

In the illustrated implementation, where the connection between the elongate rail 22 and the perimeter trim piece 100 includes the light bar 120, the light bar 120 is connected between the elongate rail 22 and the cover portion 102 of the perimeter trim piece 100. The light bar 120 can extend the full or partial length of an edge 32 of the flexible panel 30 that is attached to an elongate rail 22. The light bar 120 can be a continuous member, as generally shown, or, could include a number of discrete members. As shown, the light bar 120 extends from the inner side 108 of the cover portion 102 towards the elongate rail 22, generally in line with the elongate rail 22 and one or more of the clamps 70. The one or more illumination sources 122 are evenly spaced along the light bar 120, and each is positioned between the flexible panel 30 and the inner side 108 of the cover portion 102 to illuminate the space between the flexible panel 30 and the cover portion 102 in order to wash the outboard portions of the flexible panel 30 adjacent its edge 32 with light. The illumination sources 122 can be light emitting diodes, for example, or other sources of illumination.

The perimeter trim piece 100 can also be configured to additionally, or alternatively, support the attachment of the auxiliary flexible panels 50 and 52 in the false ceiling 10. The auxiliary flexible panel 50 includes an edge 150 configured for attachment to the perimeter trim piece 100 to at least partially suspend the auxiliary flexible panel 50 from the perimeter trim piece 100. In the illustrated example of the perimeter trim piece 100, the outer side 104 of the cover portion 102 opens to a channel 152, and the edge 150 of the auxiliary flexible panel 50 is configured for selective mateable engagement with the channel 152. The edge 150 of the auxiliary flexible panel 50 may, for example as shown, include a semi-rigid backer strip or substrate 154 that can be slid into the channel 152 and maintained in the channel 152 by friction. If the auxiliary flexible panel 50 is elastic, it will be understood that the substrate 154 can also be elastic. The remaining edges 150 of the auxiliary flexible panel 50 may similarly be attached to the same or other perimeter trim pieces 100 in the trim assembly 60. Optionally, one or more of the remaining edges 150 could be free from attachment to a perimeter trim piece 100.

The auxiliary flexible panel 52 similarly includes an edge 160 configured for attachment to the perimeter trim piece 100 to at least partially suspend the auxiliary flexible panel 52 from the perimeter trim piece 100. In the illustrated example of the perimeter trim piece 100, the inner side 108 of the cover portion 102 and the edge 160 of the auxiliary flexible panel 52 are cooperatively configured for selective mateable engagement. The inner side 108 of the cover portion 102 and the edge 160 of the auxiliary flexible panel 52 may, for example as shown, each include respective corresponding hook-and-loop attaching structures 162 and 164. If the auxiliary flexible panel 52 is elastic, it will be understood that the hook-and-loop attaching structure 164 can also be elastic.

In the illustrated cover portion 102, the hook-and-loop attaching structure 162 of the inner side 108 of the cover portion 102 is located on the upwardly extending lip 142, such that in application, the edge 160 of the auxiliary flexible panel 52 is folded over the lip 142, effectively increasing the pull out strength of the attachment between the cover portion 102 and the edge 160 of the auxiliary flexible panel 52. Moreover, the progressive incline of the display face 106 towards the plane of the auxiliary flexible sheet 52 provides a semblance of continuity between the perimeter trim piece 100 and the auxiliary flexible panel 52. The remaining edges 160 of the auxiliary flexible panel 52 may similarly be attached to the same or other perimeter trim pieces 100 in the trim assembly 60. Optionally, one or more of the remaining edges 160 could be free from attachment to a perimeter trim piece 100.

In an example implementation of the false ceiling 10, the edges 32 of the flexible panel 30 include a hook-and-loop attaching structure 166 similar to the hook-and-loop attaching structure 164 of the edge 160 of the auxiliary flexible panel 52. Thus, it will be understood the edges of the flexible panel 30 can alternatively be attached to an elongate rail 22 or to the perimeter trim piece 100.

Figure 4:
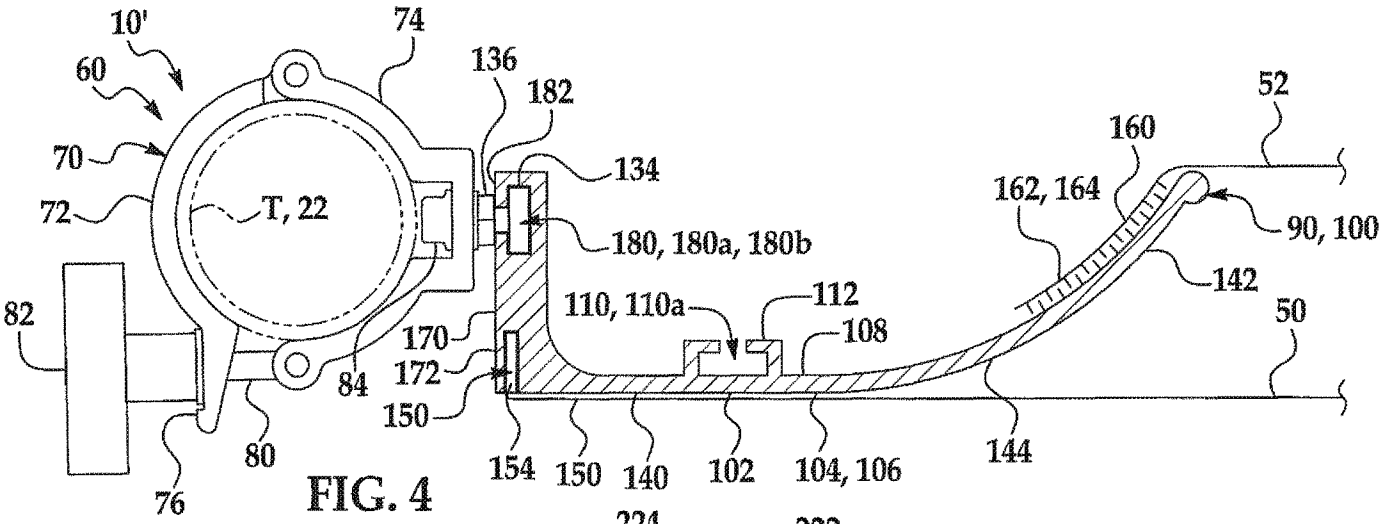
FIG. 4 is a section view of the trim assembly, showing the perimeter trim piece in an alternative configuration.

As shown with additional reference to FIG. 4, in addition to being configured to form a portion of the trim assembly trim assembly 60 for the edges 32 of the flexible panel 30 in the false ceiling 10, the illustrated perimeter trim piece 100 is configured for supporting the implementation of an alternative false ceiling 10'. In the alternative implementation of the perimeter trim piece 100, the perimeter trim piece 100 supports the attachment of the auxiliary flexible panels 50 and 52, as described above. As shown, in addition to the cover portion 102, the illustrated perimeter trim piece 100 includes a leg 170. The leg 170 extends from the inner side 108 of the cover portion 102 opposite the lip 142. In application, the leg 170 generally extends in an upright orientation, away from the outer side 104 and in a common direction as the lip 142, and out of the view of a user below the false ceiling 10'.

The leg 170 has an outer side 172 that includes the first portion **180*a* of an auxiliary connection assembly 180 for connecting the perimeter trim piece 100 to an elongate rail 22. The auxiliary connection assembly 180 additionally includes a second portion 180*b* configured for selective mateable engagement with the first portion 180*a*, and further, for connection to a clamp 70. In a similar configuration as the connection assembly 110, the first portion 180*a* of the auxiliary connection assembly 180 can comprise a track 182 constructed as a C-shaped member defining a female channel. The second portion 180*b* of the auxiliary connection assembly 180 comprises the same one or more male projections 134 described above, each having a T-shaped cross section generally corresponding in shape with the channel defined by the track 182 and configured for selective mateable engagement with the track 182, and each threaded for threaded engagement with the insert 84 of a clamp 70. The projection 134 may also include the jamb nut 136 for securing the position of the projection 134 within the insert 84 of a clamp 70. To support a given perimeter trim piece 100 with respect to an elongate rail 22 in the false ceiling 10', the projections 134 can be positioned approximately every three or four feet along the length of the perimeter trim piece 100 for mateable engagement with the track 182**.

In the illustrated and above described example, each perimeter trim piece 100 has a generally L-shaped cross sectional shape formed by the leg 170 and the cover portion 102, with the outside including the outer side 172 of the leg 170 and the outer side 104 of the cover portion 102, which defines the display face 106, and with the inside including the inner side 108 of the cover portion 102. The perimeter trim pieces 100 can be manufactured by extruding a suitable material such as aluminum or plastic, for example. In a trim assembly 60 for a given flexible panel 32, the perimeter trim pieces 100 can be manufactured to length, for example, or manufactured in one or more standard lengths and cut to size.

In order to overlay the corner 34 of the flexible panel 30 at the intersection of its two adjacent edges 32, the respective edges of two adjoining perimeter trim pieces 100 can be mitered and abutted together. Alternatively, as shown in FIG. 5, an edge 190 of the example perimeter trim piece 100 can be manufactured or cut flush, and the trim pieces 90 may include the illustrated corner trim piece 200 for overlying the corner 34 of the flexible panel 30.

The corner trim piece 200 is generally configured to accept the flush edges 190 of respective perimeter trim pieces 100 that are adjoined in the trim assembly 60 at an angle, while conveying a finished appearance to a user below the false ceiling 10. Although one corner trim piece 200 is shown, it will be understood that additional corner trim pieces 200 can be implemented at the remaining corners 34 of the flexible panel 30, if any.

Figure 5:
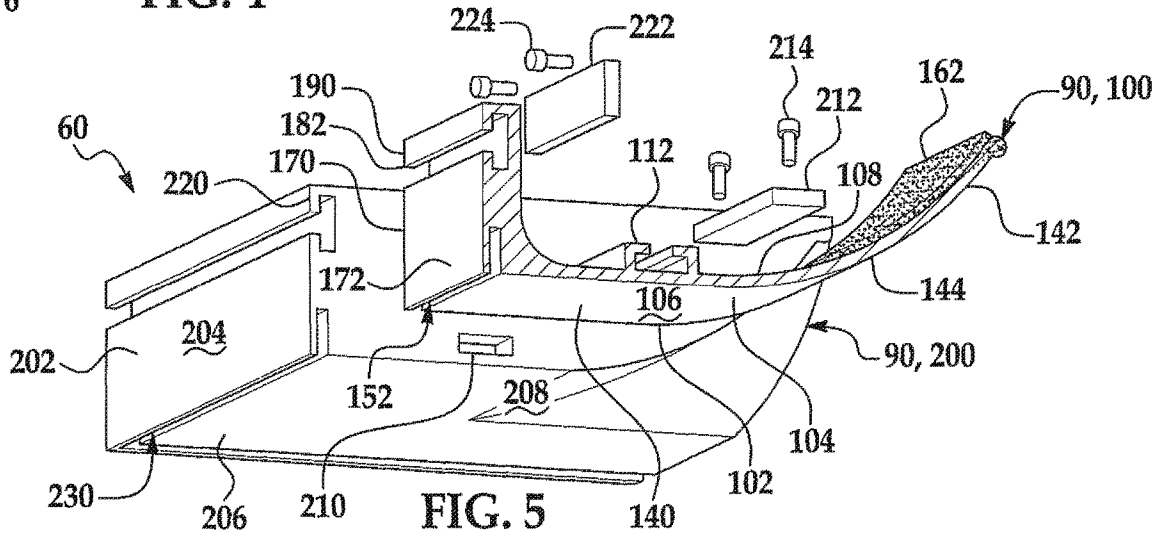
FIG. 5 is a partial assembly view of the trim assembly, showing a corner trim piece.

The illustrated corner trim piece 200 is a body of material including two orthogonally or otherwise angled outer sides 202 that each define an abutment face 204 (one outer side 202 and one abutment face 204 are shown in FIG. 5). Each of the abutment faces 204 is configured to accept the flush edge 190 of a perimeter trim piece 100 in abutting engagement. The corner piece 200 additionally includes an outer side 206 defining a display face 208 that extends between the angled outer sides 202. The display face 208 can be configured with decorative properties matching or otherwise compatible with those of the perimeter trim pieces 100. The display face 208, for example, can be angled, shaped or otherwise contoured to provide a semblance of continuity between two adjoining perimeter trim pieces 100. In the illustrated example, for instance, the display face 208 is shaped to include the intersecting contours of the display faces 106 of two adjoining perimeter trim pieces 100.

The corner trim piece 200, like the perimeter trim pieces 100, is configured to connect to one or more of the clamps 70. In the illustrated trim assembly 60, the corner trim piece 200 is configured to connect to one or more of the clamps 70 by attachment to the perimeter trim pieces 100. As shown, a track 210 opens from the outer side 202 of the corner trim piece 200 defining the abutment face 204 and corresponds in shape, size and position to the track 112 opening from the inner side 108 of the cover portion 102. To attach the corner trim piece 200 to a given perimeter trim piece 100, the track 112 of the perimeter trim piece 100 can be oriented contiguously with the track 210 of the corner trim piece 200, and a key 212 can be placed between the track 112 and the track 210. The key 212 can be secured by a friction fit, or, for example as shown, the key can be secured by driving at least one fastener 214 through the key 212 and into the perimeter trim piece 100, and at least one fastener 214 through the key 212 and into the corner trim piece 200. Alternatively, or additionally, a track 220 can open from the outer side 202 of the corner trim piece 200 defining the abutment face 204 and correspond in shape, size and position to the track 182 opening from the outer side 172 of the leg 170 of the perimeter trim piece 100. The track 182 of the perimeter trim piece 100 can be oriented contiguously with the track 220 of the corner trim piece 200, and a key 222 can be placed between the track 182 and the track 220. The key 222 can be secured by a friction fit, or, for example as shown, the key can be secured by driving at least one fastener 224 through the key 222 and into the perimeter trim piece 100, and at least one fastener 224 through the key 222 and into the corner trim piece 200.

The corner trim piece 200 can also be configured to additionally support in part the attachment of the auxiliary flexible panels 50 and 52 in the false ceiling 10. For example, as shown, a channel 230 opens from the outer side 206 of the corner trim piece 200 and corresponds in shape, size and position to the channel 152 opening from the outer side 104 of the cover portion 102. In this example, with the channel 152 of the perimeter trim piece 100 oriented contiguously with the channel 230 of the corner trim piece 200, the edge 150 of the auxiliary flexible panel 50 can be slid between the channel 152 and the channel 230 and maintained in each by friction. The corner trim piece 200 can also, for example, include a hook-and-loop attaching structure for mateably engaging the hook-and-loop attaching structure 164 of the auxiliary panel 52.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A flexible panel decor device comprising:

an elongate rigid support extending along a longitudinal axis;

an elongate trim piece extending along the longitudinal axis and supported by the rigid support, the trim piece having:

a planar portion;

a curved portion extending laterally outward from the rigid support and planar portion terminating in a leading edge positioned vertically above the planar portion;

an inner side adjacent to the leading edge, and an outer side opposite the inner side; and a first flexible panel directly connected to the inner side of the curved portion of the trim piece adjacent the leading edge, the first flexible panel abuttingly engaging and extending over the trim piece leading edge in a direction away from the rigid support.

2. The decor of claim 1 wherein the trim piece defines an elongate channel extending substantially parallel to the longitudinal axis to provide adjustable positioning of the trim piece relative to the rigid support along the longitudinal axis.

3. The decor of claim 2 wherein the trim piece elongate channel comprises a first elongate channel defined by the trim piece inner side and a second elongate channel defined by the trim piece outer surface, the first elongate channel selectively orienting the trim piece vertically below the rigid support and the second elongate channel selectively orienting the trim piece horizontally adjacent to the rigid support.

4. The decor of claim 1 wherein the first panel continuously connects to the trim piece inner side along the longitudinal axis of the trim piece.

5. The decor of claim 4 wherein the first panel extending over the leading edge and way from the rigid support defines a substantially horizontal panel.

6. The decor of claim 3 wherein:

the trim piece further comprises a leg portion orthogonally oriented relative to the planar portion, the leg portion having a first and a second wall defining an elongate open slot extending along the longitudinal axis;

a second flexible panel frictionally engaging both of the first and the second walls of the elongate slot and extending substantially horizontally across the planar portion operable to conceal substantially all of the trim piece when viewed vertically below the trim piece.

7. A flexible panel decor device comprising:

an elongate rigid support extending along a longitudinal axis;

an elongate trim piece extending along the longitudinal axis and supported by the rigid support, the trim piece having:

a planar portion;

a curved portion extending laterally outward from the rigid support and planar portion terminating in a leading edge positioned vertically above the planar portion;

an inner side, an outer side opposite the inner side; and a leg portion orthogonally oriented relative to the planar portion, the leg portion having first and second walls defining an elongate open slot extending along the longitudinal axis; and a first flexible panel frictionally engaging the leg portion first and second walls in the elongate open slot and extending across the planar portion to conceal substantially all of the trim piece when viewed at an angle orthogonal to the first flexible panel.

8. The flexible panel decor device of claim 7 further comprising a plurality of connectors engaged with the rigid support separated along the rigid support longitudinal axis, the elongate trim piece connected to the connectors to support the trim piece.

9. The flexible panel decor device of claim 7 further comprising:

a second flexible panel directly connected to the inner side of the trim piece adjacent the leading edge, the first flexible panel abuttingly engaging and extending over the trim piece leading edge in a direction away from the rigid support and parallel to the first flexible panel.

10. The decor of claim 1 wherein the trim piece is a single unitary piece.

11. The decor of claim 1 further comprising a connector engageable with the trim piece operable to selectively connect the trim piece to the rigid support.

12. The decor of claim 11 wherein the connector is a clamp.

13. The decor of claim 2 further comprising a clamp having a projection slidingly engaged with the trim piece elongate channel, the clamp further having a pair of U-shaped bodies for frictional engagement of the elongate rigid support.

14. The decor of claim 8 wherein the plurality of connectors comprise a plurality of clamps.

* * * * *